US007202405B2

(12) United States Patent
Takegawa

(10) Patent No.: US 7,202,405 B2
(45) Date of Patent: Apr. 10, 2007

(54) SNARE ASSEMBLY WITH GRADUATED TONAL EFFECT

(75) Inventor: Akito Takegawa, Chiba (JP)

(73) Assignee: Pearl Musical Instrument Co., Chiba (JP)

( * ) Notice: Subject to any disclaimer, the term of this patent is extended or adjusted under 35 U.S.C. 154(b) by 266 days.

(21) Appl. No.: 10/797,025

(22) Filed: Mar. 11, 2004

(65) Prior Publication Data

US 2005/0150353 A1 Jul. 14, 2005

Related U.S. Application Data

(60) Provisional application No. 60/535,813, filed on Jan. 13, 2004.

(51) Int. Cl.
*G10D 13/02* (2006.01)

(52) U.S. Cl. ..... 84/415

(58) Field of Classification Search ..... 84/411 R, 84/415–417

See application file for complete search history.

(56) References Cited

U.S. PATENT DOCUMENTS

| | | | | |
|---|---|---|---|---|
| 1,207,825 | A | 12/1916 | Wheeler | |
| 1,431,836 | A | 10/1922 | Nelson | |
| 1,816,328 | A | 7/1931 | James | |
| 2,085,819 | A | 7/1937 | Meyer | |
| 2,101,784 | A | 12/1937 | Logan | |
| 2,517,124 | A * | 8/1950 | Ludwig et al. | 84/415 |
| 3,757,027 | A | 9/1973 | Morena et al. | |
| 4,095,505 | A | 6/1978 | Hoey et al. | |
| 5,204,484 | A | 4/1993 | Netto | |
| 5,507,214 | A | 4/1996 | Hoshino | |
| 5,844,157 | A | 12/1998 | Kasha | |
| 6,689,944 | B1 * | 2/2004 | Okumura | 84/411 R |
| 2004/0031375 | A1 * | 2/2004 | Hayden | 84/415 |

* cited by examiner

*Primary Examiner*—Kimberly Lockett
(74) *Attorney, Agent, or Firm*—Berenato, White & Stavish

(57) ABSTRACT

A snare assembly for application in a snare drum including a cylindrical shell, a lower drum head and an upper drum head oppositely secured to the drum shell, and a snare strainer mounted to the drum shell for applying tension to the snare assembly. The snare assembly mounted adjacent the lower drum head of the drum and comprises a pair of end members and a plurality of generally parallel snare strands extending between and each permanently attached at opposite ends thereof to respective ones of the end members. The snare strands of the snare assembly have continuously graduated effective lengths for providing continuously graduated tension of the snare strands in a transverse direction of the snare assembly when the snare strands are elongated in an axial direction thereof by the snare strainer. Consequently, the snare assembly generates a musical tone continuously graduated in transverse direction of the snare assembly.

22 Claims, 9 Drawing Sheets

SNARE ASSEMBLY WITH GRADUATED TONAL EFFECT

CROSS-REFERENCE TO RELATED APPLICATION

This Application claims the benefit under 35 U.S.C. 119(e) of U.S. Provisional Application No. 60/535,813 filed Jan. 13, 2004 by Akito TAKEGAWA.

BACKGROUND OF THE INVENTION

1. Field of the Invention

The present invention relates to a snare drum in general, and more particularly to an improved snare assembly having a graduated tonal effect.

2. Description of the Prior Art

The standard modern snare drum generally comprises two drum heads stretched across opposite sides of a cylindrical drum shell and a snare assembly including a series of snare strands situated on the bottom head. The snare strands are attached to a strainer clamp mounted on one side of the drum shell and run across the bottom head to another strainer clamp mounted on the opposite side of the shell.

Typically, the snare strands have substantially equal effective length and tension across the snare assembly. Consequently, the dynamic range of the conventional snare assembly is limited.

Therefore, there is a need for a snare assembly having extended dynamic range that would allow to broaden the dynamic range of the drum to acquire unique sound character.

SUMMARY OF THE INVENTION

The present invention provides a novel snare assembly for use with a snare drum. The general object of this invention is to provide a snare assembly having a graduated tonal effect. The snare drum includes a substantially cylindrical drum shell, a lower drum head and an upper drum head oppositely secured to the drum shell, a snare assembly mounted to the snare drum, and a strainer mounted to the drum shell to apply tension to the snare assembly. The snare assembly, in turn, comprises a pair of spaced end members and a plurality of generally parallel snare strands extending between and each permanently attached at opposite ends thereof to respective ones of the end members. In accordance with the present invention, the snare strands have continuously graduated effective lengths for providing continuously graduated tension of the snare strands in a transverse direction of the snare assembly when the snare strands are elongated in an axial direction thereof.

At least one of the end members of the snare assembly of the present invention is provided with a curved inner edge so that the opposite ends of the snare strands are permanently secured to a bottom surface of the at least one of the end members substantially along the curved inner edge thereof in order to continuously graduate the effective lengths of the snare strands in the transverse direction of the snare assembly.

Consequently, when tension is applied to the snare assembly through the strainer, the snare strands are elongated by pulling apart the end members. As the snare strands have different effective length, the tension of the snare strands continuously varies from one side of the snare assembly to another in the transverse direction, thus providing a graduated tonal effect.

In accordance with the first exemplary embodiment of the present invention, the end member is substantially D-shaped so that the inner edge thereof is substantially convex. As the snare strands are permanently secured to a bottom surface of the holding plate substantially along the inner edge thereof, the effective length of the snare strands in a middle portion of the snare assembly is shorter than the effective length of the snare strands at side portions thereof. Therefore, the tension of the snare strands increases in the transverse direction of the snare assembly from the side portions of the snare assembly to the middle portion thereof.

In accordance with the second exemplary embodiment of the present invention, the end member is substantially C-shaped so that the inner edge thereof is substantially concave. As the snare strands are permanently secured to a bottom surface of the holding plate substantially along the inner edge thereof, the effective length of the snare strands in a middle portion of the snare assembly is longer than the effective length of the snare strands at side portions thereof. Therefore, the tension of the snare strands decreases in the transverse direction of the snare assembly from the side portions of the snare assembly to the middle portion thereof.

Alternatively, the inner edge of the end member of the snare assembly may have a substantially triangular shape with an outwardly or inwardly pointed apex, in the form of a straight line at an angle to the transverse direction of the snare assembly, in the form of a broken line or curved line, etc. In other words, the inner edge of the end member of the snare assembly may have any appropriate contour (curved or straight) that provides the continuously graduate effective lengths of the snare strands in the transverse direction of the snare assembly.

Therefore, the present invention represents a novel arrangement of the snare assembly including snare strands having continuously graduated effective lengths for providing continuously graduated tension of the snare strands in transverse direction when the snare strands are elongated in axial direction thereof. The snare assembly of the present invention provides snare drums with a graduated tonal effect and has extended dynamic range in comparison to the snare drums of the prior art.

BRIEF DESCRIPTION OF THE DRAWINGS

Other objects and advantages of the invention will become apparent from a study of the following specification when viewed in light of the accompanying drawings, wherein.

DETAILED DESCRIPTION OF PREFERRED EMBODIMENTS

The preferred embodiments of the present invention will now be described with the reference to accompanying drawings.

Figure 1:
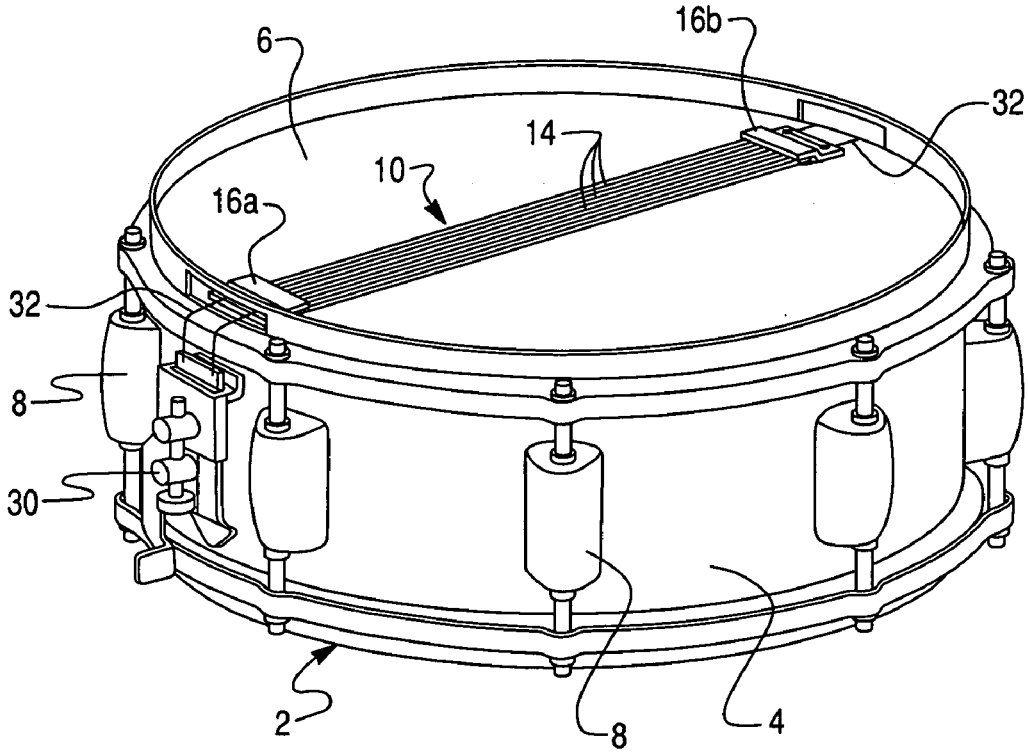
FIG. 1 is a perspective view of a snare drum fitted with a snare assembly in accordance with a first exemplary embodiment of the present invention.

FIG. 1 shows a snare drum 2 equipped with a snare assembly 10 of the first exemplary embodiment of the present invention. As illustrated, the snare drum 2 of known construction comprises a cylindrical drum shell 4, a lower drum head 6, an upper drum head (not shown), and a series of fittings 8 around the drum shell 4 for adjusting the tension of the drum heads. As further illustrated in FIG. 1, the snare assembly 10 is mounted adjacent the lower drum head 6 of the drum 2.

Figure 3:
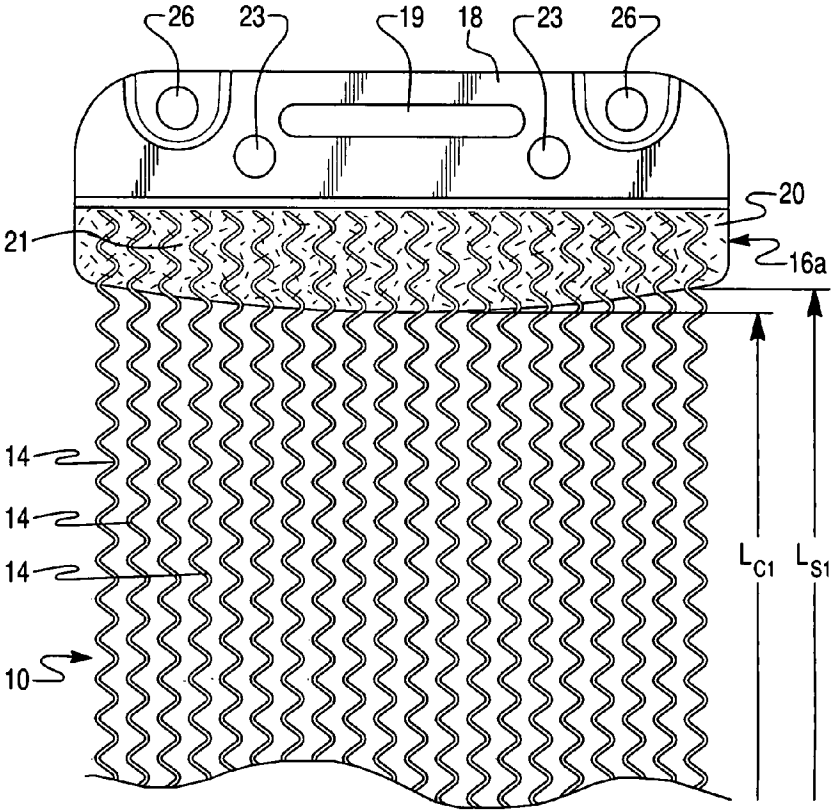
FIG. 3 is a partial bottom view of the snare assembly in accordance with the first exemplary embodiment of the present invention.
Figure 2:
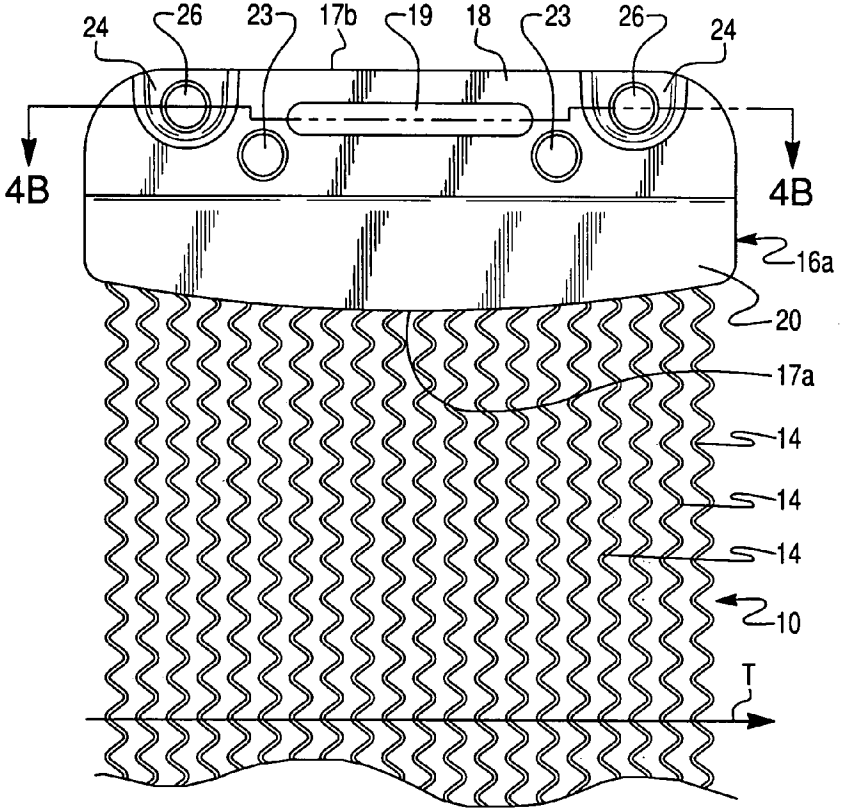
FIG. 2 is a partial top view of the snare assembly in accordance with the first exemplary embodiment of the present invention.
Figure 4B:
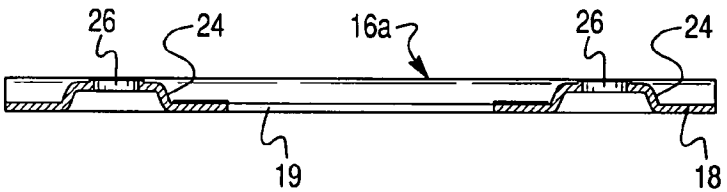
FIG. 4B is a front view of the snare assembly in accordance with the first exemplary embodiment of the present invention taken along line 4B—4B in FIG. 2.
Figure 4A:
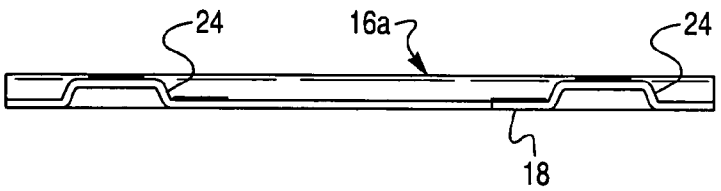
FIG. 4A is a front view of the snare assembly in accordance with the first exemplary embodiment of the present invention.
Figure 5:
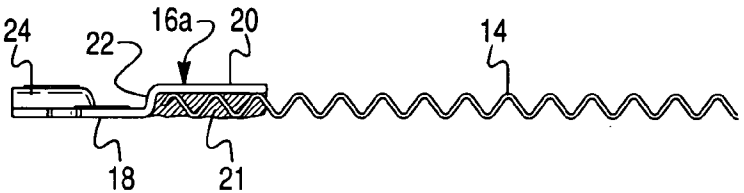
FIG. 5 is a partial side view of the snare assembly in accordance with the first exemplary embodiment of the present invention.

As illustrated in detail in FIGS. 2 and 3, the snare assembly 10 of the first exemplary embodiment of the present invention comprises a plurality of snare strands 14 extending between two end members 16*a* and 16*b* so that distal ends of the snare strands 14 are permanently secured to the end members 16*a* and 16*b*. Moreover, the snare strands 14 are arranged in side-by-side relationship in substantially one plane. Preferably, the snare strands 14 are in the form of spirally wound metal wires. However, it will be appreciated that the snare strands 14 may in any other appropriate form known in the art, such as straight (non wound) strand or including an elongated core member and an outer wrap wound about the core member, and of any other appropriate material, such as plastic. Preferably, the snare assembly 10 of the first exemplary embodiment of the present invention includes 20 snare strands. However, it is to be realized that more or less snare strands may be employed depending upon the particular designs.

The means for attaching the snare assembly 10 to the drum 2 may vary widely without departing from the invention. In FIG. 1, for example, the snare assembly 10 is mounted to the drum 2 by means of the end members 16*a* and 16*b*. More specifically, the end member 16*a* is attached to a conventional strainer 30 by a cord 32. The strainer 30 is mounted to the drum shell 4 to apply tension to the snare strands 14. On the other hand, the end member 16*b* is attached by another cord 32 to a conventional butt (not shown) attached to the drum shell 4 diametrically opposite from the strainer 30 and not visible in FIG. 1.

Preferably, however not exclusively, the end members 16*a* and 16*b* of the snare assembly 10 are substantially identical. Thus, only the end member 16*a* is illustrated in detail in FIGS. 2–5. As shown, the end member 16*a* is an integral, single-piece element having an inner edge 17*a* and an outer edge 17*b*, and includes a mounting plate 18 and a holding plate 20 vertically and longitudinally offset from the mounting plate 18 via an offset portion 22. The mounting plate 18 is adapted to secure the end member 16*a* (thus, a distal end of the snare assembly 10) to the drum 2, while the holding plate 20 is adapted to permanently secure distal ends of the snare strands 14 to the end member 16*a*.

The mounting plate 18 is provided with a transverse slot 19 and holes 23 adjacent to ends of the slot 19 whereby the snare assembly 10 is secured to the drum 2 by either a band looped through the slot 19 or cords passed through the holes 23. Furthermore, the mounting plate 18 is formed with two raised portions 24, each defining a "tunnel" open to the outer edge 17*b* of the end member 16*a*, as shown in FIGS. 4A–8. Each of the raised portions 24 is provided with holes 26 adapted to receive cords passed therethrough for securing the snare assembly 10 to the drum 2.

Figure 6A:
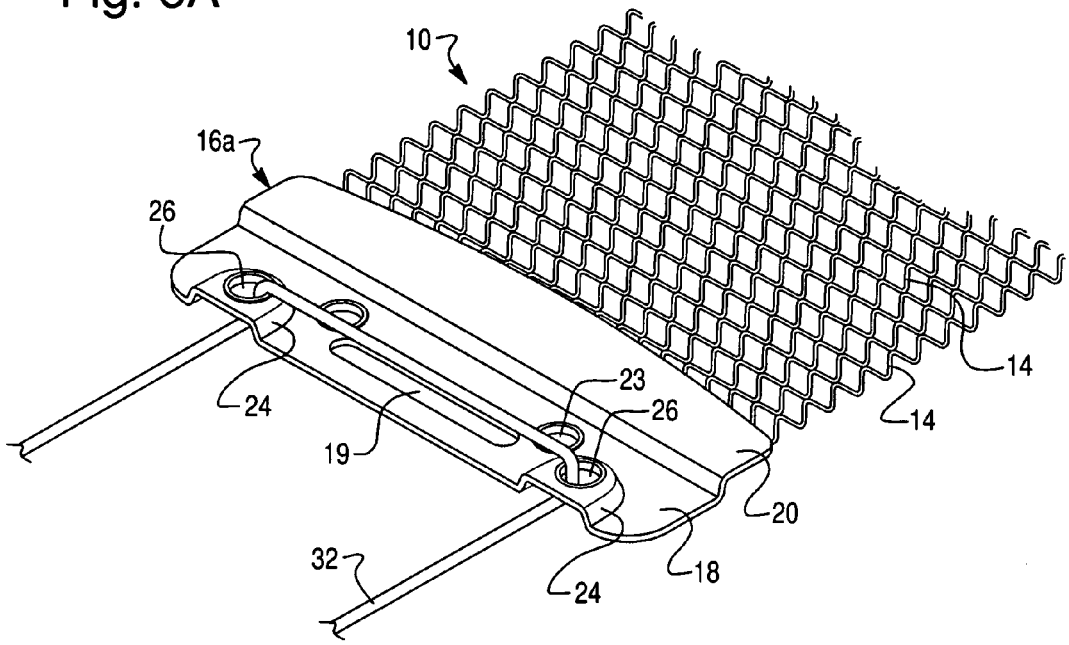
FIG. 6A is a partial perspective view of the snare assembly in accordance with the first exemplary embodiment of the present invention shown with a mounting cord extending through holes in raised portions formed on one of the end members.
Figure 6B:
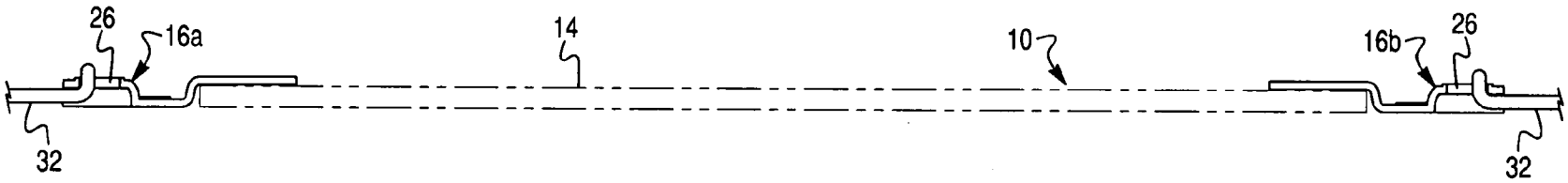
FIG. 6B is a side view of the snare assembly shown in FIG. 6A.

The above described arrangement of the end members 16*a* and 16*b* allows to secure the snare assembly 10 to the drum 2 in three different manners. First, the snare assembly 10 may be secured to the drum 2 by the cord 32 passing through the holes 26 in the raised portions 24 of the end members so as to extend through the "tunnels" within the raised portions 24 allowing the end members 16*a* and 16*b* to lie flat against a surface of the lower drum head 6 in direct contact therewith, as illustrated in FIGS. 6A and 6B. In this position, as seen in FIG. 6B, the snare assembly 10 lies flat against the drum head 6 of the snare drum 2 that makes the snare response sensitive as all the snare strands 14 are making contact with the drum head 6.

Figure 7A:
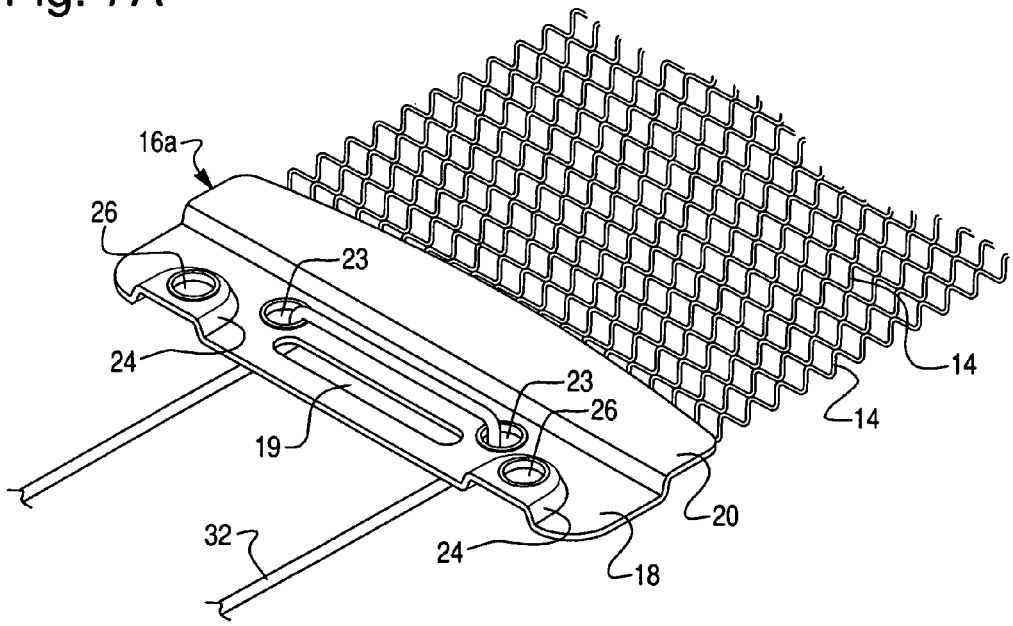
FIG. 7A is a partial perspective view of the snare assembly in accordance with the first exemplary embodiment of the present invention shown with a mounting cord extending through a pair of holes in one of the end members.
Figure 7B:
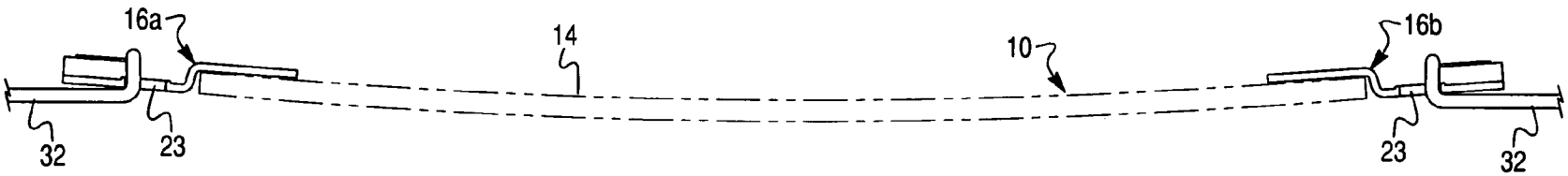
FIG. 7B is a side view of the snare assembly shown in FIG. 7A.

Second, the snare assembly 10 may be secured to the drum 2 by the cord 32 passing through the holes 23 in the end members so as to extend below the mounting plate 18 of the end members 16*a* and 16*b*, thus lifting the end members 16*a* and 16*b* (and, consequently, the snare assembly 10) above the surface of the lower drum head 6 with no direct contact therewith, as illustrated in FIGS. 7A and 7B. In this position, as seen in FIG. 7B, the snare strands 14 are bowed toward the drum head 6 of the snare drum 2 producing a crispy yet muted sound.

Figure 8B:
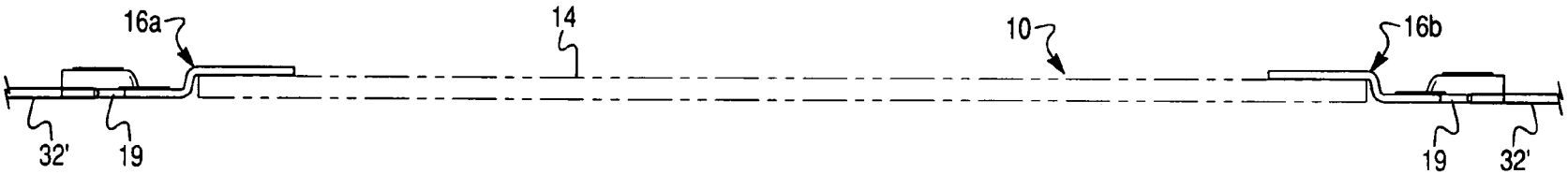
FIG. 8B is a side view of the snare assembly shown in FIG. 8A.
Figure 8A:
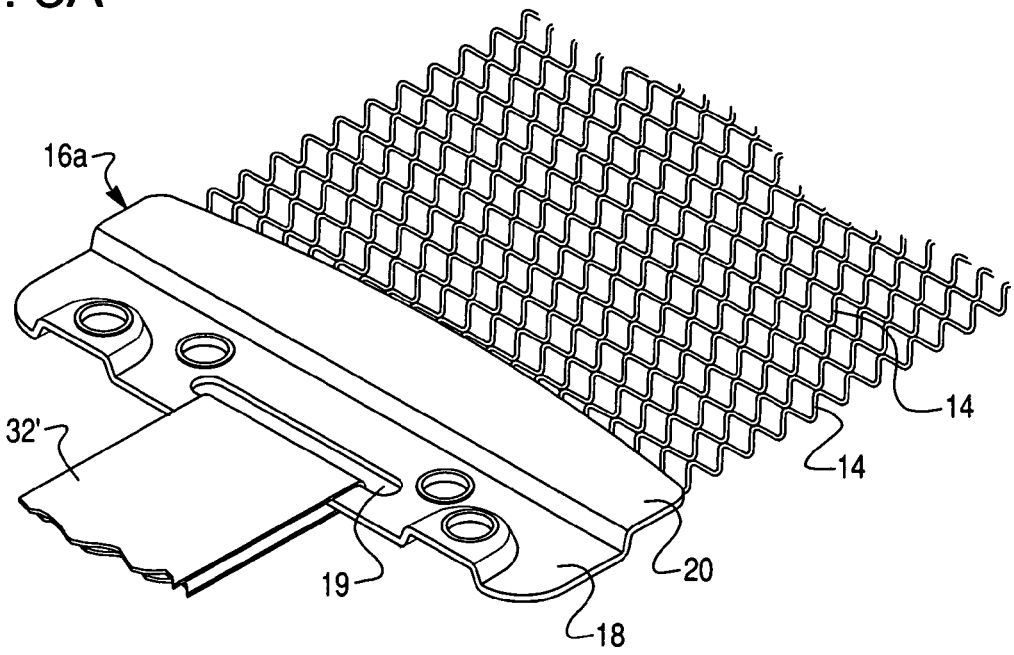
FIG. 8A is a partial perspective view of the snare assembly in accordance with the first exemplary embodiment of the present invention shown with a mounting strap extending through a slot in one of end members.

Third, the snare assembly 10 may be secured to the drum 2 by a band (or strap) 32' looped through the slot 19 so as to extend below the mounting plate 18 of the end members 16*a* and 16*b*, thus lifting the end members 16*a* and 16*b* (and, consequently, the snare assembly 10) above the surface of the lower drum head 6 with no direct contact therewith, as illustrated in FIGS. 8A and 8B. In this position, as seen in FIG. 8B, the snare strands 14 lightly contact the drum head 6 of the snare drum 2 producing an "airy" sound.

It will be appreciated that any appropriate materials (such as metal, plastic, etc.) and thickness of the end members of the snare assembly may be used. Accordingly, the cord 32 and the strap 32' may be of any appropriate materials, such as metal, plastic, fabric, etc.

The distal ends of the snare strands 14 are secured to a bottom surface of the holding plate 20 of the end member 16*a* by any appropriate means known in the art, such as soldering, brazing, welding, adhesive bonding, etc. A solder material or an adhesive, is denoted in FIGS. 3 and 5A by the reference numeral 21.

Figure 9A:
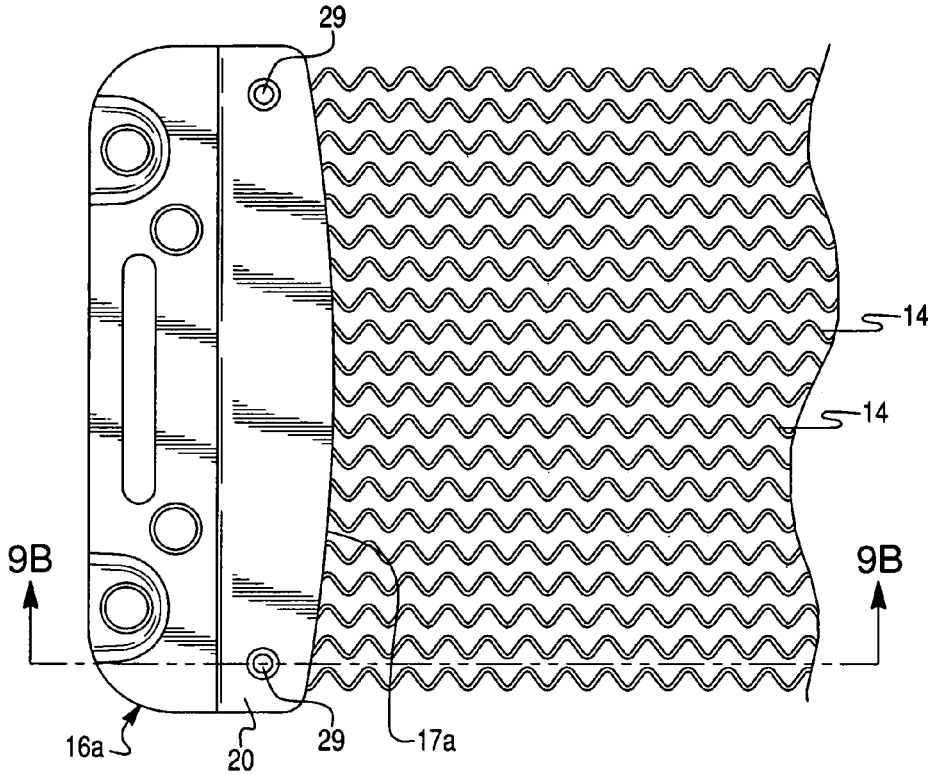
FIG. 9A is a partial top view of the snare assembly in accordance with the first exemplary embodiment of the present invention shown with snare strands secured to the end member by clamping.
Figure 9B:
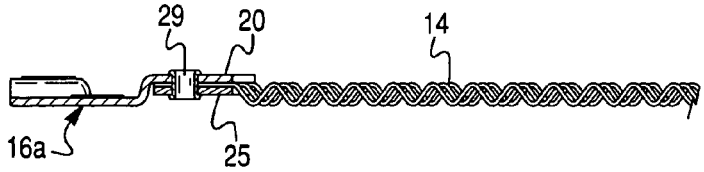
FIG. 9B is a cross-sectional view along the line 9B—9B in FIG. 9A.
Figure 9C:
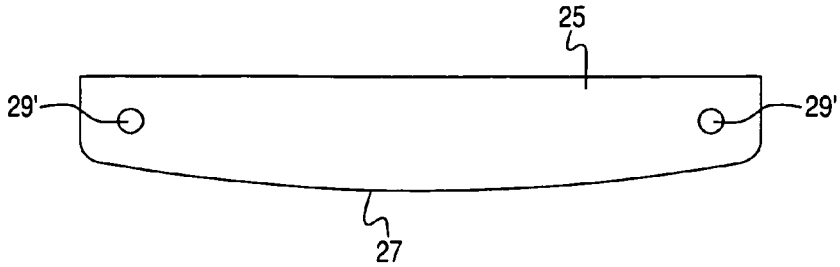
FIG. 9C is a top view of a clamping plate.

Alternatively, as illustrated in FIGS. 9A and 9B, the distal ends of the snare strands 14 are secured to the bottom surface of the holding plate 20 of the end member 16*a* by clamping the distal ends of the snare strands 14 between the holding plate 20 of the end member 16*a* and a clamping plate 25. The clamping plate 25, illustrated separately in FIG. 9C, is secured to the bottom surface of the holding plate 20 of the end member 16*a* by any appropriate means known in the art, such as rivets 29 or threaded fasteners, adhesive bonding, etc. As further illustrated in FIG. 9C, an inner edge 27 of the clamping plate 25 is substantially identical in profile to the inner edge 17*a* of the end member 16*a* and is substantially aligned thereto when secured to the bottom surface of the holding plate 20, as shown in FIGS. 9A and 9B. The clamping plate 25 may be formed with holes 29' provided to receive the fasteners, such as rivets 29.

In accordance with the first exemplary embodiment of the present invention, as illustrated in detail in FIGS. 2 and 3, the holding plate 20 of the end member 16*a* is substantially D-shaped so that the inner edge 17*a* of the holding plate 20 of the end member 16*a* is substantially convex. As the snare strands 14 are permanently secured to a bottom surface of the holding plate 20 substantially along the inner edge 17*a* thereof, the effective length of the snare strands 14 continuously graduated from one side of the snare assembly 10 to the other in a transverse direction T of the snare assembly 10.

It will be appreciated that the term "transverse direction" is referred to a direction across the snare strands 14, or substantially perpendicular to a direction of the snare strands 14 between the end members 16*a* and 16*b*, defined herein as an axial direction.

Consequently, when tension is applied to the snare assembly 10 through the strainer 30, the snare strands 14 are elongated by pulling apart the end members 16*a* and 16*b* and, thus, pre-tensioned. As the snare strands 14 are permanently secured to the end members 16*a* and 16*b*, each of the snare strands 14 is elongated to the same distance. However, because the snare strands 14 have different effective length, the relative elongation of the snare strands 14 continuously varies in the transverse direction with respect to the snare assembly 10. Accordingly, the tension of the snare strands 14 continuously varies from one side of the snare assembly to another in the transverse direction T, thus providing a graduated tonal effect.

More specifically, in accordance with the first exemplary embodiment of the present invention, as shown in FIG. 3, the snare strands 14 have the effective length $L_{C1}$ in the middle portion of the snare assembly 10, and the effective length $L_{S1}$, at the side portions thereof. As illustrated, $L_{C1}<L_{S1}$. In other words, the snare assembly 10 of the first exemplary embodiment of the present invention provides the snare strands 14 having shorter effective length in the middle portion of the snare assembly (effective length $L_{C1}$) than at the side portions thereof (effective length $L_{S1}$). Therefore, the tension of the snare strands 14 increases in the transverse direction of the snare assembly from the side portions of the snare assembly to the middle portion thereof.

Figure 10B:
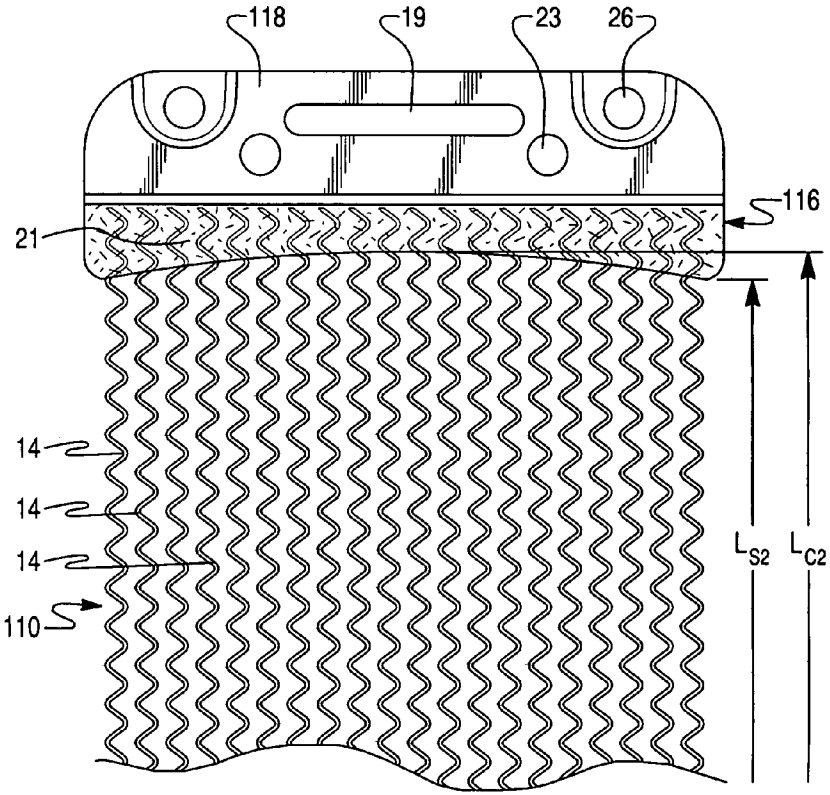
FIG. 10B is a partial bottom view of the snare assembly in accordance with the second exemplary embodiment of the present invention.
Figure 10A:
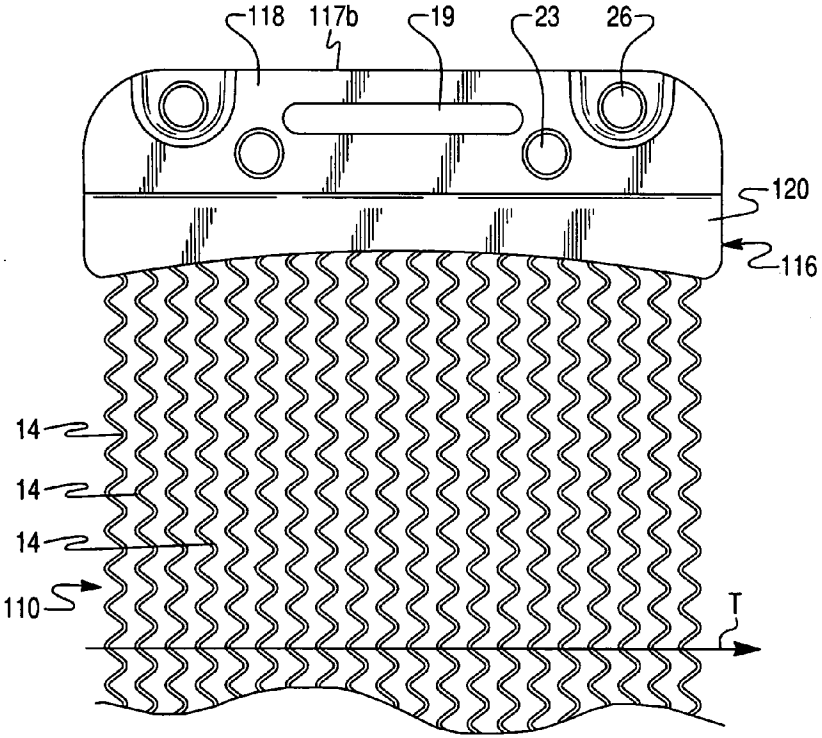
FIG. 10A is a partial top view of the snare assembly in accordance with a second exemplary embodiment of the present invention.

FIGS. 10A and 10B illustrate a snare assembly in accordance with the second exemplary embodiment of the present invention, generally denoted by the reference numeral 110. Components, which are unchanged from, or function in the same way as in the first exemplary embodiment depicted in FIGS. 1–9C are labeled with the same reference numerals, sometimes without describing detail since similarities between the corresponding parts in the two embodiments will be readily perceived by the reader. The snare assembly of FIGS. 10A and 10B substantially corresponds to the snare assembly of FIGS. 1–9C, and only the end members, which differ, will therefore be explained in detail below.

As illustrated in detail in FIGS. 10A and 10B, the snare assembly 110 comprises a plurality of snare strands 14 extending between two end members 116 so that distal ends of the snare strands 14 are permanently secured to the end members 116.

Preferably, the end members 116 of the snare assembly 110 are substantially identical. Thus, only the end member 116 is illustrated in detail in FIGS. 10A and 10B. As shown, the end member 116 is an integral, single-piece element having an inner edge 117*a* and an outer edge 117*b*, and includes a mounting plate 118 and a holding plate 120 vertically and longitudinally offset from the mounting plate 118. The mounting plate 118 is substantially identical to the mounting plate 18 of the end member 16*a* in accordance with the first exemplary embodiment of the present invention.

The distal ends of the snare strands 14 are permanently secured to a bottom surface of the holding plate 120 of the end member 116 by any appropriate means known in the art, such as soldering, brazing, welding, adhesive bonding, etc. In accordance with the second exemplary embodiment of the present invention, as illustrated in detail in FIGS. 10A and 10B, the holding plate 120 of the end member 116 is substantially C-shaped so that the inner edge 117*a* of the holding plate 120 of the end member 116 is substantially concave. As the snare strands 14 are permanently secured to a bottom surface of the holding plate 120 substantially along the inner edge 117*a* thereof, the effective length of the snare strands 14 continuously graduated from one side of the snare assembly 110 to the other in the transverse direction. More specifically, as shown in FIG. 10B, the snare strands 14 of the snare assembly 110 have the effective length $L_{C2}$ in the middle portion of the snare assembly 110 of the second exemplary embodiment of the present invention, and the effective length $L_{S2}$ at the side portions thereof. As illustrated, $L_{C2}>L_{S2}$.

In other words, the snare assembly 110 of the second exemplary embodiment of the present invention provides the snare strands 14 having longer effective length in the side portion of the snare assembly (effective length $L_{C2}$) than at the middle portions thereof (effective length $L_{S2}$).

When tension is applied to the snare assembly 110 through the strainer 30, the snare strands 14 are elongated by pulling apart the end members 116. Consequently, as the snare strands 14 have longer effective length in the middle portion of the snare assembly 110 of the second exemplary embodiment of the present invention than in the side portions thereof in the transverse direction, the tension of the snare strands 14 decreases in the transverse direction of the snare assembly from the side portions of the snare assembly to the middle portion thereof.

Therefore, the present invention represents a novel arrangement of the snare assembly including snare strands having continuously graduated effective lengths for providing continuously graduated tension of the snare strands in transverse direction when the snare strands are elongated in axial direction thereof. The snare drum employing the snare assembly of the present invention has extended dynamic range in comparison to the snare drums of the prior art.

Figure 11:
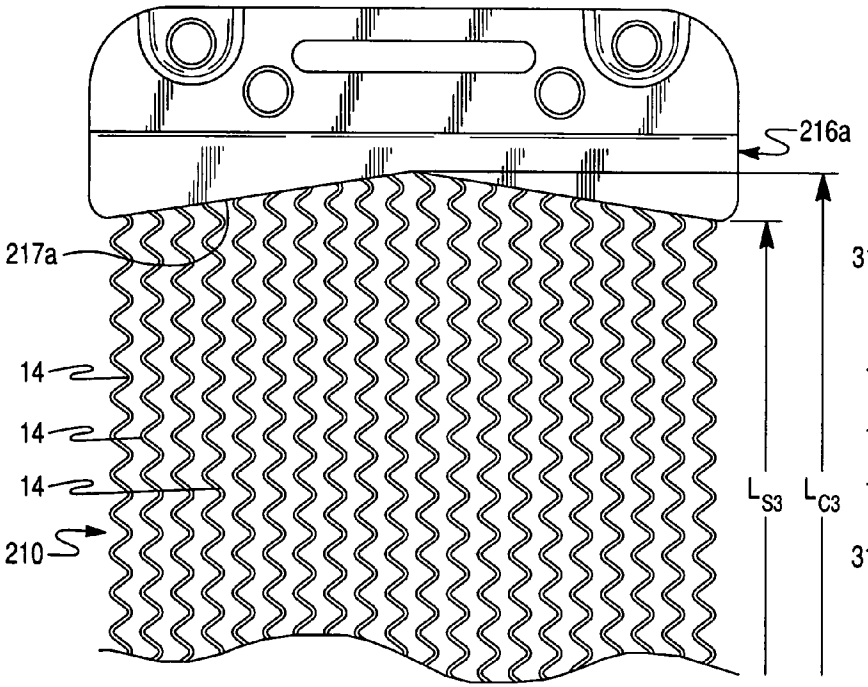
FIG. 11 is a partial top view of the snare assembly in accordance with a third exemplary embodiment of the present invention.

It will be appreciated that any other appropriate contour of the inner edge (17*a* or 117*a*) of the holding plate (20 or 120) of the end member (16 or 116) that provides the snare assembly with snare strands having continuously varying effective lengths and tension is within the scope of the present invention. For example, in accordance with the third exemplary embodiment of the present invention, a snare assembly 210 may have an end member 216*a* including an inner edge 217*a* having a substantially triangular shape with an outwardly pointed apex, as illustrated in FIG. 11. More specifically, the snare strands 14 have the effective length $L_{C3}$ in the middle portion of the snare assembly 210, and the effective length $L_{S3}$ at the side portions thereof. As illustrated, $L_{C3}>L_{S3}$. In other words, the snare assembly 210 of the third exemplary embodiment of the present invention provides the snare strands 14 having longer effective length in the middle portion of the snare assembly (effective length $L_{C3}$) than at the side portions thereof (effective length $L_{S3}$).

Figure 12:
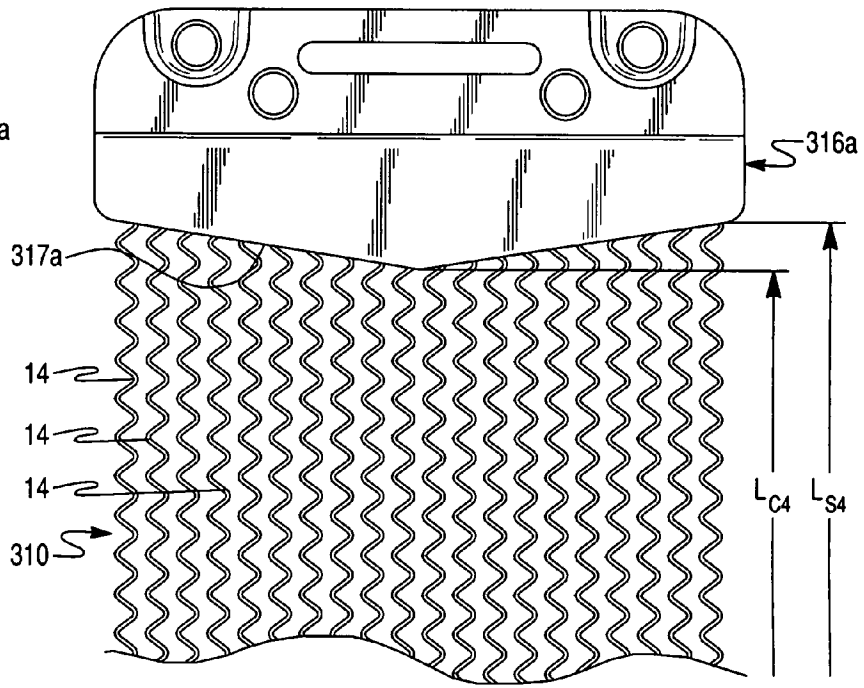
FIG. 12 is a partial top view of the snare assembly in accordance with a fourth exemplary embodiment of the present invention.

Alternatively, in accordance with the fourth exemplary embodiment of the present invention, a snare assembly 310 may have an end member 316*a* including an inner edge 317*a* having a substantially triangular shape with an inwardly pointed apex, as illustrated in FIG. 12. More specifically, the snare strands 14 have the effective length $L_{C4}$ in the middle portion of the snare assembly 310, and the effective length $LS_4$ at the side portions thereof. As illustrated, $L_{C4}<L_{S4}$. In other words, the snare assembly 310 of the fourth exemplary embodiment of the present invention provides the snare strands 14 having longer effective length at the side portions of the snare assembly (effective length $L_{S4}$) than in the middle portion thereof (effective length $L_{C4}$).

Further alternatively, the inner edge of the end member of the snare assembly may be in the form of a straight line at an angle to the transverse direction T of the snare assembly, in the form of a broken line or curved line, etc.

It will be appreciated by those skilled in the art that the snare assembly with snare strands having continuously varying effective lengths and tension provides percussion instruments with a graduated tonal effect and substantially extends the dynamic range of the drum as looser snare strands (less tension) respond to the lightest touch, thus extending the sensitivity of the drum at low volume (delicate) levels, while tighter snare strands (more tension) "kick-in" at high volume levels, hence extending the drum's dynamic range at extremely loud (aggressive) playing levels.

The foregoing description of the preferred embodiments of the present invention has been presented for the purpose of illustration in accordance with the provisions of the Patent Statutes. It is not intended to be exhaustive or to limit the invention to the precise forms disclosed. Obvious modifications or variations are possible in light of the above teachings. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A snare assembly for use with a snare drum, said snare assembly comprising:

a pair of spaced end members; and a plurality of generally parallel snare strands extending between and each attached at opposite ends thereof to respective ones of said end members;

said snare strands having continuously graduated effective lengths for providing continuously graduated tension of said snare strands in a transverse direction of said snare assembly when said snare strands are elongated in an axial direction thereof, wherein at least one of said end members is provided with a curved inner edge so that said opposite ends of said snare strands are secured to a bottom surface of said at least one of said end members substantially along said curved inner edge thereof in order to continuously graduate said effective lengths of said snare strands in the transverse direction of the snare assembly.

2. The snare assembly as defined in claim 1, wherein said curved inner edge of said at least one of said end members is convex so that said effective lengths of said snare strands in a middle portion of said snare assembly is shorter than said effective length of said snare strands at side portions thereof.

3. The snare assembly as defined in claim 1, wherein said curved inner edge of said at least one of said end members is concave so that said effective lengths of said snare strands in a middle portion of said snare assembly is longer than said effective length of said snare strands at side portions thereof.

4. The snare assembly as defined in claim 1, wherein said snare strands are arranged in side-by-side relationship in substantially one plane.

5. The snare assembly as defined in claim 1, wherein said snare strands are made of spirally wound metal wires.

6. The snare assembly as defined in claim 1, wherein each of said snare strands is permanently attached at opposite ends thereof to said respective end members by one of a soldering, brazing, welding and adhesive bonding.

7. The snare assembly as defined in claim 1, wherein said end members are substantially identical.

8. A snare assembly for use with a snare drum, said snare assembly comprising:

a pair of spaced end members; and a plurality of generally parallel snare strands extending between and each attached at opposite ends thereof to respective ones of said end members;

said snare strands having continuously graduated effective lengths for providing continuously graduated tension of said snare strands in a transverse direction of said snare assembly when said snare strands are elongated in an axial direction thereof, wherein at least one of said end members is provided with an inner edge in the form of a straight line at an angle to the transverse direction of said snare assembly so that said opposite ends of said snare strands are secured to a bottom surface of said at least one of said end members substantially along said angled inner edge thereof in order to continuously graduate said effective lengths of said snare strands in the transverse direction of the snare assembly.

9. A snare assembly as for use with a snare drum, said snare assembly comprising:

a pair of spaced end members; and a plurality of generally parallel snare strands extending between and each attached at opposite ends thereof to respective ones of said end members;

said snare strands having continuously graduated effective lengths for providing continuously graduated tension of said snare strands in a transverse direction of said snare assembly when said snare strands are elongated in an axial direction thereof, wherein at least one of said end members is provided with v-shaped inner edge so that said opposite ends of said snare strands are secured to a bottom surface of said at least one of said end members substantially along said inner edge thereof in order to continuously graduate said effective lengths of said snare strands in at least two opposite directions in the transverse direction of the snare assembly.

10. The snare assembly as defined in claim 1, wherein each of said snare strands is attached at opposite ends thereof to said respective end members by clamping.

11. A snare drum comprising:

a substantially cylindrical drum shell;

a lower drum head and an upper drum head oppositely secured to said drum shell;

a snare assembly mounted to said snare drum, said snare assembly including a pair of spaced end members and a plurality of generally parallel snare strands extending between and each permanently attached at opposite ends thereof to respective ones of said end members; and a strainer mounted to said drum shell to apply tension to said snare strands of said snare assembly;

wherein at least one of said end members is provided with an inner edge at an angle to the transverse direction of said snare assembly so that said opposite ends of said snare strands are secured to a bottom surface of said at least one of said end members substantially along said angled inner edge thereof in order to continuously graduate said effective lengths of said snare strands in the transverse direction of the snare assembly.

12. The snare drum as defined in claim 11, wherein said snare assembly is mounted adjacent said lower drum head of said snare drum.

13. The snare drum as defined in claim 11, wherein said snare strands are arranged in side-by-side relationship in substantially one plane.

14. The snare drum as defined in claim 11, wherein at least one of said end members is provided with a curved inner edge so that said opposite ends of said snare strands are permanently secured to a bottom surface of said at least one of said end members substantially along said curved inner edge thereof in order to continuously graduate said effective lengths of said snare strands in the transverse direction.

15. The snare drum as defined in claim 14, wherein said curved inner edge of said at least one of said end members is convex so that said effective lengths of said snare strands in a middle portion of said snare assembly is shorter than said effective length of said snare strands at side portions thereof.

16. The snare drum as defined in claim 14, wherein said curved inner edge of said at least one of said end members is concave so that said effective lengths of said snare strands in a middle portion of said snare assembly is longer than said effective length of said snare strands at side portions thereof.

17. The snare drum as defined in claim 11, wherein at least one of said end members is provided with an inner edge in the form of a straight line at an angle to the transverse direction of said snare assembly so that said opposite ends of said snare strands are secured to a bottom surface of said at least one of said end members substantially along said angled inner edge thereof in order to continuously graduate said effective lengths of said snare strands in the transverse direction of the snare assembly.

18. The snare drum as defined in claim 11, wherein at least one of said end members is provided with an inner edge in the form of a broken line so that said opposite ends of said snare strands are secured to a bottom surface of said at least one of said end members substantially along said inner edge thereof in order to continuously graduate said effective lengths of said snare strands in the transverse direction of the snare assembly.

19. The snare drum as defined in claim 11, wherein said end members are substantially identical and each of said end members is provided with a curved inner edge so that said opposite ends of said snare strands are permanently secured to a bottom surface of said at least one of said end members substantially along said curved inner edge thereof in order to continuously graduate said effective lengths of said snare strands in the transverse direction.

20. The snare drum as defined in claim 11, wherein said snare strands are made of spirally wound metal wires.

21. The snare drum as defined in claim 11, wherein each of said snare strands is permanently attached at opposite ends thereof to said respective end members by one of a soldering, brazing, welding and adhesive bonding.

22. The snare drum as defined in claim 11, wherein each of said snare strands is attached at opposite ends thereof to said respective end members by clamping.

* * * * *